US005963231A

United States Patent [19]

Shima et al.

[11] Patent Number: 5,963,231

[45] Date of Patent: Oct. 5, 1999

[54] ELECTROSTATIC INK JET RECORDING HEAD WITH GROUPED ELECTRODES

[75] Inventors: Kazuo Shima; Junichi Suetsugu; Ryosuke Uematsu; Hitoshi Minemoto; Yoshihiro Hagiwara, all of Tokyo, Japan

[73] Assignee: NEC Corporation, Tokyo, Japan

[21] Appl. No.: 08/701,646

[22] Filed: Aug. 26, 1996

[30] Foreign Application Priority Data

Aug. 28, 1995 [JP] Japan ..... 7-218780

[51] Int. Cl.[6] ..... B41J 2/06

[52] U.S. Cl. ..... 347/55

[58] Field of Search ..... 347/55, 141, 151, 347/112

[56] References Cited

U.S. PATENT DOCUMENTS

| | | | |
|---|---|---|---|
| 4,794,463 | 12/1988 | Tamara et al. | 347/55 |
| 5,654,745 | 8/1997 | Luque | 347/55 |

FOREIGN PATENT DOCUMENTS

| | | | |
|---|---|---|---|
| 56-167466 | 12/1981 | Japan . | |
| 56-167473 | 12/1981 | Japan | B41J 2/06 |
| 61-57343 | 3/1986 | Japan | 347/55 |
| 1-141056 | 6/1989 | Japan | 347/55 |
| 6-278307 | 10/1994 | Japan . | |
| WO 93/11866 | 6/1993 | WIPO . | |

*Primary Examiner*—Benjamin R. Fuller
*Assistant Examiner*—C. Dickens
*Attorney, Agent, or Firm*—Young & Thompson

[57] ABSTRACT

An ink jet recording head includes ejection electrodes arranged along ink paths that each have an ink outlet at one end and communicate with an ink chamber at the other end. The ejection electrodes are arranged in electrode sets, each set consisting of a number of ejection electrodes. The electrode sets have their corresponding ejection electrodes short-circuited, and are provided with control electrodes that are each common to respective ejection electrodes of a corresponding electrode set, and that are rearwardly offset from front ends of the ejection electrodes in an ink discharge direction. A voltage driver selectively imposes a voltage to groups of electrodes to provide a discharge biasing function, and selectively imposes a lower potential than a potential of the ejection electrodes to the control electrodes to provide a discharge restricting function.

4 Claims, 7 Drawing Sheets

(0<Voc<Vor<Vr<Vc<Vm)

ELECTROSTATIC INK JET RECORDING HEAD WITH GROUPED ELECTRODES

BACKGROUND OF THE INVENTION

The present invention generally relates to an electrostatic ink jet recording device, and particularly, to an ink jet recording device of an electrostatic type in which an electrostatic potential field is developed to have charged toner particles in ink forced to fly onto a recording medium, where they are deposited to effect a recording or printing.

Description of the Related Art

FIG. 1 shows principal parts of a conventional ink jet recorder of such the type.

In FIG. 1, designated at reference character R0 is the conventional ink jet recorder. The conventional recorder R0 includes as hardware components thereof a paper sheet feed system (hereafter "sheet feeder") F0, an ink jet head assembly H0 of a serial printing type installed in an unshown housing of the sheet feeder F0, a controller C0 installed in the feeder housing for synchronously controlling actions of the head assembly H0 and sheet feeder F0, and an unshown power supply in the feeder housing.

The sheet feeder F0 includes a sheet transfer mechanism for feeding a paper sheet 54 as well as for holding the same 54 in position. The transfer mechanism includes a platen 56 for rolling up and down the paper sheet 54 in an inching manner, and an unshown carriage bar extending in parallel with the platen 56. The platen 56 has an insulating platen body 56*a*, and a cylindrical conductive sheet member (hereafter "opposing electrode") 56*b* put on an entire outside-diameter surface of the platen body 56*a*. The opposing electrode 56*b* is connected to a grounded node GND so that a rolled portion of the paper sheet 54 has a grounded potential.

The ink jet head assembly H0 includes a head proper or head body (hereafter sometimes simply "head") 50, an unshown head carrier for carrying the head 50 along the carriage bar in the sheet feeder F0, a voltage driver 55 fixed to the feeder housing for electrically driving the head 50 to have an electrostatic potential field developed between the head 50 and the opposing electrode 56*b*, and an unshown flexible flat code for connection between the head 50 and the voltage driver 55.

The head 50 includes an ink chamber 52 connected via an unshown circulation pump to an unshown ink cartridge, and a horizontal array of parallel ink paths 53 of which a respective one communicates at its rear end with the ink chamber 52 and has at its front end an ink outlet 51 as a toner discharge orifice.

Each ink path 53 is formed as a fine slit between a head body member and a bottom substrate 58, as the slit is defined by unshown spacers at both sides thereof. For an intended recording, supplied ink contains a system of adequate toner particles dispersed in a transparent solution.

The head 50 further includes an array of ejection electrodes 57 extending along the ink paths 53, and an array of pads 59 as lead contacts formed on the substrate 58 and connected to the ejection electrodes 57 in a one-to-one corresponding manner. The opposing electrode 56*b* of the platen 56 is arranged in opposition to the ink outlet 51, i.e. to a front end of each ejection electrode 57, with a sheet transfer gap left in between, so that the potential field is developed between the recording and opposing electrodes 57 and 56*b*, when a required working voltage is imposed on the electrode 57.

The voltage driver 55 includes an array of voltage imposing circuits 55*a* connected to the pads 59 in a one-to-one corresponding manner, for selectively imposing the working voltage on the ejection electrodes 59. Each voltage imposing circuit 55*a* is composed of a switcing transistor 55*b* controlled from the controller C0, and a voltage source 55*c* connected between the transistor 55*b* and a grounded node GND.

In operation of the recorder R0, the ink chamber 52 is supplied with a volume of circulating ink containing charged toner particles, so that a column of ink invades therefrom into each ink path 53, forming an ink meniscus at the ink outlet 51.

As the required voltage is imposed on an arbitrary ejection electrode 57, there is substantially independently developed a potential field between the ejection electrode 57 and the grounded opposing electrode 56*b*, forcing charged toner particles in ink in a corresponding ink path 53 to fly from the ink outlet 51, toward the opposing electrode 56*b*. Flying toner particles are caught by a paper sheet 54 on the platen 56, where they are deposited to be subjected to a thermal fixing. As a result, a dot is printed on the sheet.

In the conventional recorder R0, however, the substrate 58 of the head 50, which has formed thereon the pads 59 identical in number to the ejection electrodes 57, needs to be relatively large in size, causing the head 50 to be undesirably large, resulting in an undesirably large recorder size.

The present invention has been achieved with such points in mind.

SUMMARY OF THE INVENTION

It therefore is an object of the present invention to provide an electrostatic ink jet recording device, permitting a reduced size, in particular of a head substrate.

To achieve the object, a genus of the present invention provides an electrostatic ink jet recording device comprising a recording medium feed system for feeding a recording medium (and/or holding the recording medium) in a predetermined position, an ink jet head composed of a head member defining an ink chamber and an array of N ink paths communicating with the ink chamber at rear ends thereof, where N is a predetermined integer, the N ink paths each having an ink jet outlet at a front end thereof, a substrate member formed with a total of M pads, where M is a predetermined integer, and an array of N ejection electrodes each extending along a corresponding one of the N ink paths, the ink jet head being applicable so that the respective ink jet outlets of the N ink paths oppose the recording medium, as it is in the predetermined position, an ink supply system for supplying ink containing toner particles charged in a polarity, the ink supply system including, the ink chamber, and the N ink paths, and a potential field generation system for generating a potential field having a total of N potential distributions substantially independently developed along a total of N imaginary axes each extending along a correspondent one of the N ink paths, to cause a selective one of the N ink paths to discharge a quantity of toner particles from the ink jet outlet, the potential field generation system comprising an opposing electrode applicable in opposition to the N ejection electrodes, with the recording medium in between, as it is in the predetermined position, the N ejection electrodes being settled into a total of I electrode sets each consisting of a total of J ejection electrodes, where I and J are predetermined integers such that I×J=N, the N ejection electrodes also being grouped into a total of J electrode groups each consisting of a total of I ejection electrodes each constituting a corresponding one of the J ejection electrodes of a corresponding one of the I electrode sets, a total of I control electrodes each cooperative with the J ejection electrodes of a correspondent one of the I electrode sets to control a total of J associated ones of the N potential distributions, the M pads including a total of J pads each connected to a pertinent one of the J electrode groups, and a total of I pads each connected to a pertinent one of the I control electrodes, a total of M voltage imposing circuits each connected to a pertinent one of the M pads for supplying a voltage signal to the pertinent pad, and control means for controlling the respective voltage signals of the M voltage imposing circuits.

According to a species of the genus of the invention, the electric field generation system further comprises a conducting electrode provided in the ink chamber, the M pads including an interconnection pad connected to the conducting electrode, and the M voltage imposing circuits including a migration voltage imposing circuit connected to the interconnection pad for imposing a migration voltage on the conducting electrode to provide the N potential distributions with a biased tendency to discharge toner particles.

According to another species of the genus of the invention, the voltage signal for an arbitrary one of the N ejection electrodes is variable between a first high level and a first low level so that an associated one of the N potential distributions has a variable tendency to effect one of a discharge and a non-discharge of toner particles, and the voltage signal for one of the I control electrodes cooperative with the arbitrary ejection electrode is controllable between a second high level and a second low level so that the variable tendency of the associated potential distribution is controllable to disable the discharge of toner particles.

According to another species of the genus of the invention, the substrate member includes a first conductive layer formed with the N ejection electrodes, a second conductive layer formed with the I control electrodes, and an insulating layer formed between the first and second conductive layers.

According to another species of the genus of the invention the N ejection electrodes each extend beyond the ink jet outlet of the corresponding ink path.

Moreover, to achieve the object, another genus of the present invention provides an electrostatic ink jet recording device comprising a recording medium feed system for feeding a recording medium in a predetermined position, an ink jet head composed of a head member defining an ink chamber and an array of N' ink paths communicating with the ink chamber at rear ends thereof, where N' is a predetermined integer, the N' ink paths each having an ink jet outlet at a front end thereof, a substrate member formed with a total of M pads, where M is a predetermined integer, and an array of N' ejection electrodes each extending along a corresponding one of the N' ink paths, the ink jet head being applicable so that the respective ink jet outlets of the N' ink paths oppose the recording medium, as it is in the predetermined position, an ink supply system for supplying ink containing toner particles charged in a polarity, the ink supply system including the ink chamber, and the N' ink paths, and a potential field generation system for generating a potential field having a total of N' potential distributions substantially independently developed along a total of N' imaginary axes each extending along a correspondent one of the N' ink paths, to cause a selective one of the N' ink paths to discharge a quantity of toner particles from the ink jet outlet, the potential field generation system comprising an opposing electrode applicable in opposition to the N' ejection electrodes, with the recording medium in between, as it is in the predetermined position, the N' ejection electrodes being settled into a total of I electrode sets each consisting of a total of J ejection electrodes, where I and J are predetermined integers such that $I \times J = N = N' - \Delta N$, and another electrode set consisting of a total of $\Delta N$ ejection electrodes, the N' ejection electrodes being grouped into a total of $J - \Delta N$ electrode groups each consisting of a total of I ejection electrodes each constituting a corresponding one of the J ejection electrodes of a corresponding one of the I electrode sets, and a total of $\Delta N$ electrode groups each consisting of a total of I+1 ejection electrodes of which I ejection electrodes each constitute a corresponding one of the J ejection electrodes of a corresponding one of the I electrode sets and of which the remaining ejection electrode constitutes a corresponding one of the $\Delta N$ ejection electrodes of said another electrode set, a total of I+1 control electrodes of which I control electrodes are each cooperative with the J ejection electrodes of a correspondent one of the I electrode sets to control a total of J associated ones of the N' potential distributions and of which the remaining control electrode is cooperative with the $\Delta N$ ejection electrodes of said another electrode set to control a total of $\Delta N$ associated ones of the N' potential distributions, the M pads including a total of J pads of which $J - \Delta N$ pads are each connected to a pertinent one of the $J - \Delta N$ electrode groups and of which $\Delta N$ pads are each connected to a pertinent one of the $\Delta N$ electrode groups, and a total of I+1 pads of which I pads are each connected to a pertinent one of the I control electrodes and of which the remaining pad is connected to said remaining control electrode, a total of M voltage imposing circuits each connected to a pertinent one of the M pads for supplying a voltage signal to the pertinent pad, and control means for controlling the respective voltage signals of the M voltage imposing circuits.

Further, to achieve the object, another genus of the present invention provides an electrostatic ink jet recording device including a plurality of ink paths each having an ink discharge outlet at one end thereof and communicating with an ink chamber at other ends thereof, a plurality of ejection electrodes arranged along the ink paths, an opposing electrode grounded and arranged in opposition to the respective ink discharge outlets of the ink paths with a sheet transfer route in between, and a voltage driver for selectively imposing a voltage to the ejection electrodes, wherein the ejection electrodes are settled into a plurality of electrode sets each consisting of a number of ejection electrodes, the electrode sets have corresponding ones of the respective numbers of ejection electrodes thereof short-circuited, respectively, and a plurality of recording control electrodes each common to the number of ejection electrodes of a corresponding one of the electrode sets are each disposed at a rearwardly offset position from ends of the ejection electrodes of the corresponding electrode set in an ink discharge direction, and wherein the voltage driver selectively imposes the voltage to a plurality of electrode groups each consisting of the short-circuited corresponding ejection electrodes to have a discharge biasing function and selectively sets a lower potential than a potential of the corresponding ejection electrodes to the recording control electrodes to have a discharge restricting function.

According to a species of this genus of the injvention, the ink chamber is provided with a conducting electrode, and the voltage driver sets a higher potential than the potential of the ejection electrodes to the conducting electrode to have a migration biasing function.

According to another species of this genus of the injvention, the voltage driver has a time-lag driving function for setting the lower potential than the potential of the ejection electrodes to a selected one of the control electrodes before imposing the voltage to the ejection electrodes.

Toner particles contained in the ink may be charged in a positive polarity. In use of toner particles charged in a negative polarity, respective electrodes may be reversed in polarity.

Therefore, according to the invention, a voltage is imposed on a group of short-circuited ejection electrodes, and a potential of a control electrode cooperative with an electrode set including one of the short-circuited ejection electrodes that is intended to be put in a non-discharge state is set to be lower than a potential of the ejection electrodes.

At the electrode set in which no discharge is desired, charged toner particles in ink tends to be concentrated near the control electrode which is rearwardly offset from front ends of cooperative ejection electrodes, so that the toner particles are substantially kept free from effects of a potential field developed between these ejection electrodes and an opposing electrode. As a result, no discharge is effected.

Further, according to the invention, an ink chamber is provided with a conducting electrode, and a voltage driver is adapted for providing the conducting electrode with a higher potential than potentials of ejection electrodes to have a migration biasing function.

Accordingly, there is developed a corresponding potential distribution between the conducting electrode and an opposing electrode, such that charged toner particles in the ink chamber have an increased tendency to migrate toward an ink meniscus formed in a vicinity of a front end of each ejection electrode.

Still more, according to the invention, a voltage driver has a time-lag driving function for providing a control electrode with a lower potential than potentials of cooperative ejection electrodes before imposing a recording voltage to a concerned one of the ejection electrodes.

Accordingly, at a set of ejection electrodes including a particular electrode, where no discharge is desired, those particles shifted near front ends of the ejection electrodes are once brought back to a located position of a cooperative control electrode, before the particular electrode is applied with a recording voltage.

BRIEF DESCRIPTION OF THE DRAWINGS

The objects, features and advantages of the present invention will become more apparent from consideration of the following detailed description, in conjunction with the accompanying drawings, in which.

DESCRIPTION OF THE PREFERRED EMBODIMENTS

Figure 1:
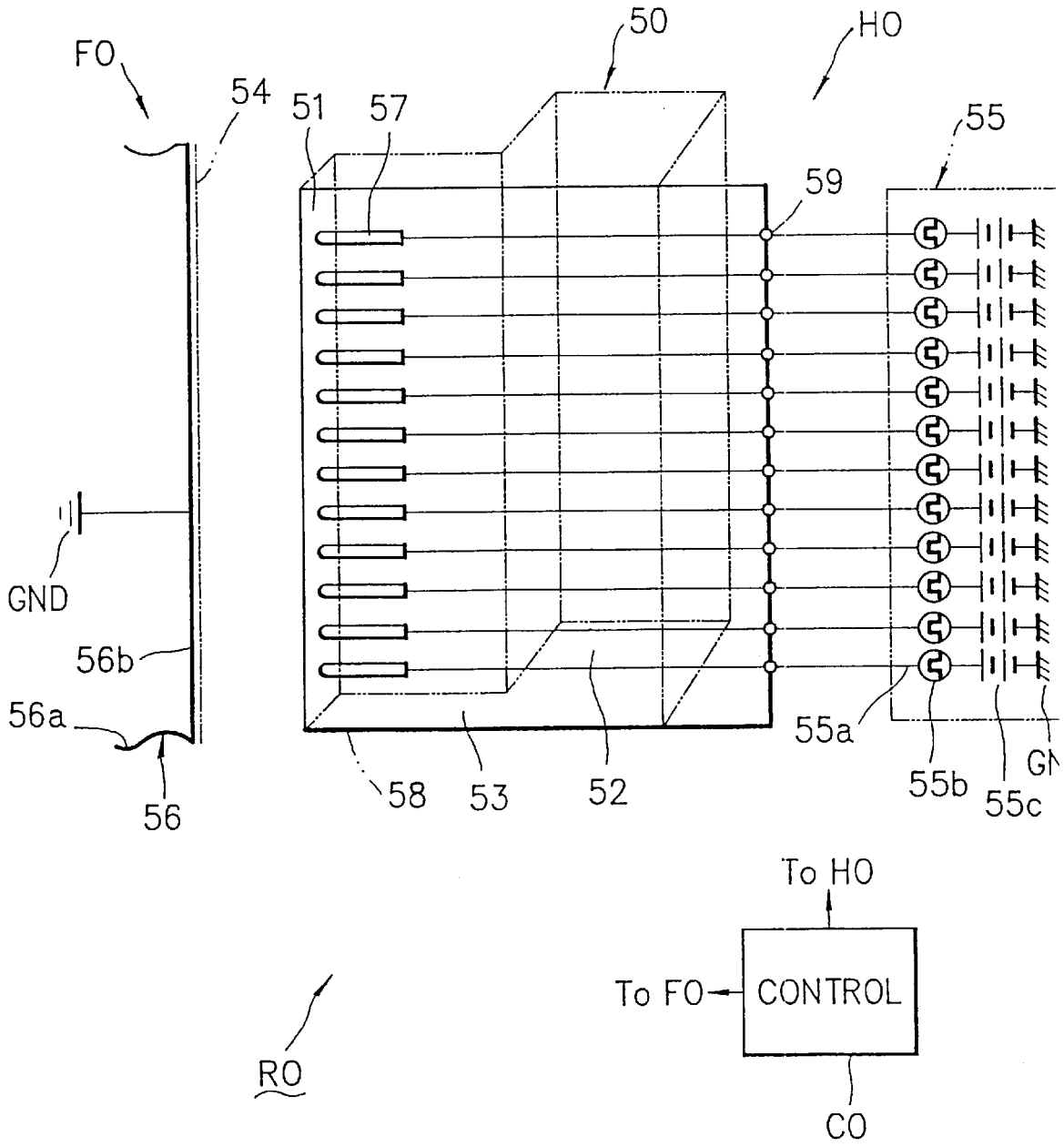
FIG. 1 PRIOR ART
FIG. 1 is a schematic illustration describing arrangement and connection of principal parts of a conventional ink jet recorder of an electrostatic type.

There will be detailed below the preferred embodiments of the present invention, with reference to the accompanying drawings. Like members are designated by like reference characters.

Figure 2:
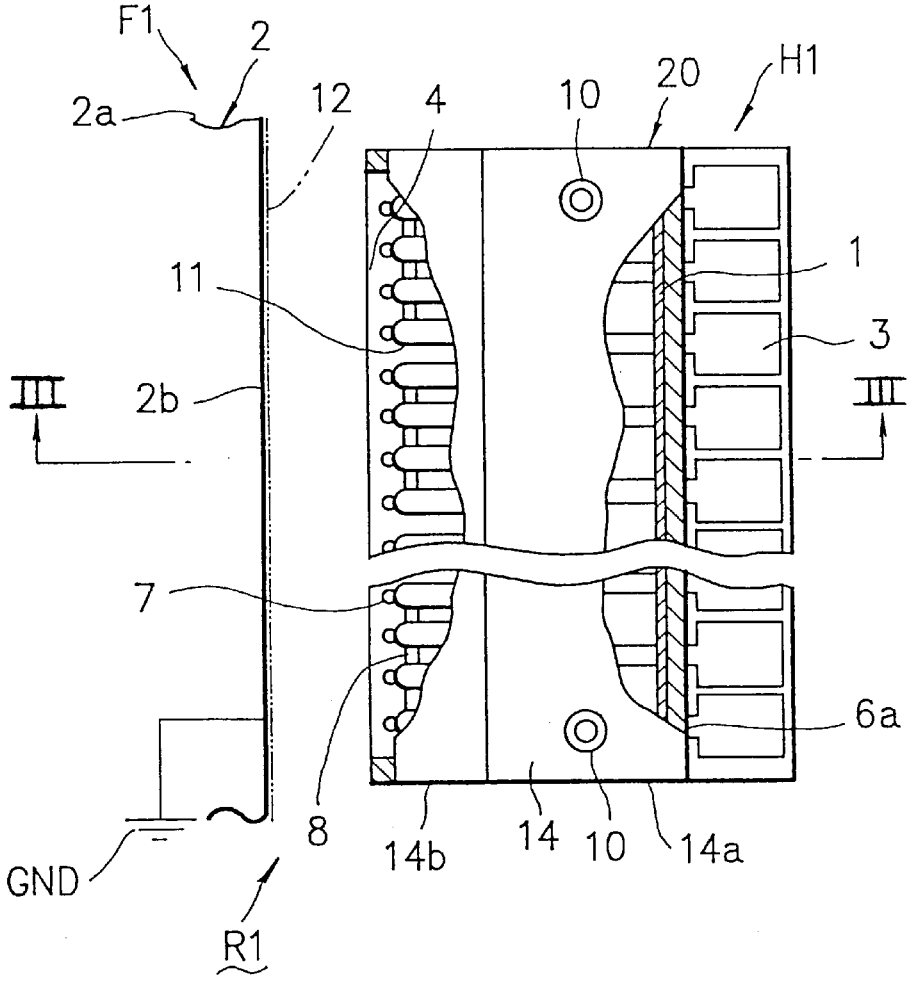
FIG. 2 is a plan, partly in section, of essential parts of an electrostatic ink jet recording device according to the invention.
Figure 3:
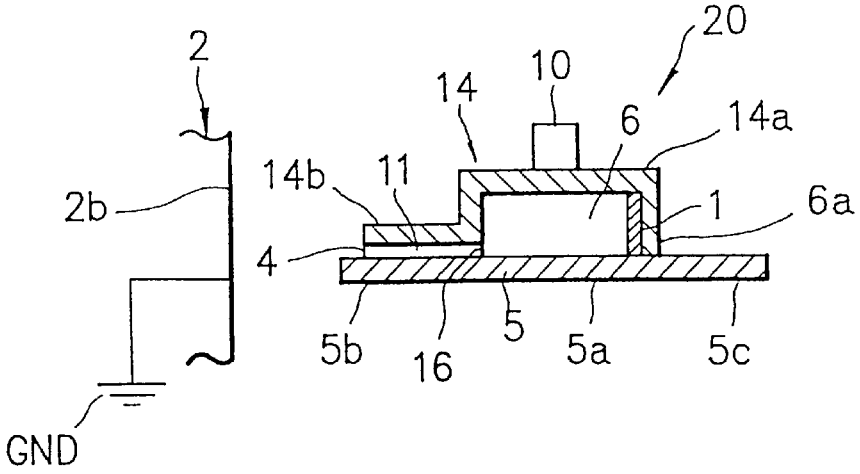
FIG. 3 is a section along line 1—1 of FIG. 2.

FIG. 2 shows, in a partially sectioned plan, essential parts of an electrostatic ink jet recording device according to the invention. FIG. 3 is a section along line 1—1 of FIG. 2.

In FIG. 2, designated at reference character R1 is the ink jet recording device (hereafter sometimes simply "recorder") according to the invention. The recorder R1 is substantially analogous in component arrangement to the conventional one R0, so it includes a paper sheet feeder F1, an ink jet head assembly H1 of a serial printing type installed in an unshown housing of the sheet feeder F1, an unshown controller, and an unshown power supply.

The sheet feeder F1 includes a sheet transfer mechanism, which has a platen 2 for rolling up and down a paper sheet 12, and an unshown carriage bar extending in parallel with the platen 2. The platen 2 has an insulating platen body 2*a*, and a cylindrical conductive sheet member as an opposing electrode 2*b* put on the platen body 2*a*. The opposing electrode 2*b* is connected to a grounded node GND so that a rolled portion of the paper sheet 12 has a grounded potential.

The ink jet head assembly H1 includes a head 20, an unshown head carrier for carrying the head 20 along the, carriage bar, a later-described voltage driver 13 (cf. FIG. 4) fixed to the feeder housing for electrically driving the head 20 to have a variable electrostatic potential field generated between the head 20 and the opposing electrode 2*b*, and an unshown flexible flat code for connection between the head 20 and the voltage driver.

The head 20 includes an ink chamber 6 connected by a pair of ink slots 10 to an ink circulation circuit having an unshown circulation pump and an unshown ink cartridge, and a horizontal array of parallel ink paths 11 of which a respective one communicates at its rear end with the ink chamber 6 and has at its front end an ink outlet 4 as a toner discharge orifice.

The ink chamber 6 is defined by a convexed rear part 14*a* of a shaped head cover member 14 and an intermediate part 5*a* of a substantially flat bottom substrate 5, and has installed therein a conducting electrode 1 extending along a rear wall 6*a* thereof.

Each ink path 11 is formed as a fine slit between a stepped-down front part 14*b* of the head cover member 14 and a front peripheral part 5*b* of the substrate 5, as the slit is defined by spacers 16 at both sides thereof.

The head 20 further includes an array of ejection electrodes 7 each extending in a longitudinal direction of a corresponding one of the ink paths 11, an array of transversely elongate recording control electrodes 8 each commonly cooperative with a total of four crossing ejection electrodes 7 to effect a discharge restriction control, and an array of rectangular pads 3 as lead contacts formed by a patterning along a rear peripheral part 5*c* of the substrate 5 and connected in a one-to-one corresponding manner to the conducting electrode 1 and the control electrodes 8 and in an every-fourth commonly grouping manner to the ejection electrodes 7.

The opposing electrode 2*b* of the platen 2 is arranged as a single member to oppose each ink outlet 4, i.e. to a front end of each ejection electrode 7 whereever the head 20 may be carried, with a sheet transfer gap guaranteed in between, so that the potential field can be generated between the migration and opposing electrodes 1 and 2*b* and varied in a later-described manner, as level-controlled voltages are selectively imposed on the pads 3 to thereby achieve at each ink outlet 4 a voluntary combination of a discharge tendency activating or biassing effect and a discharge tendency restricting effect.

Figure 4:
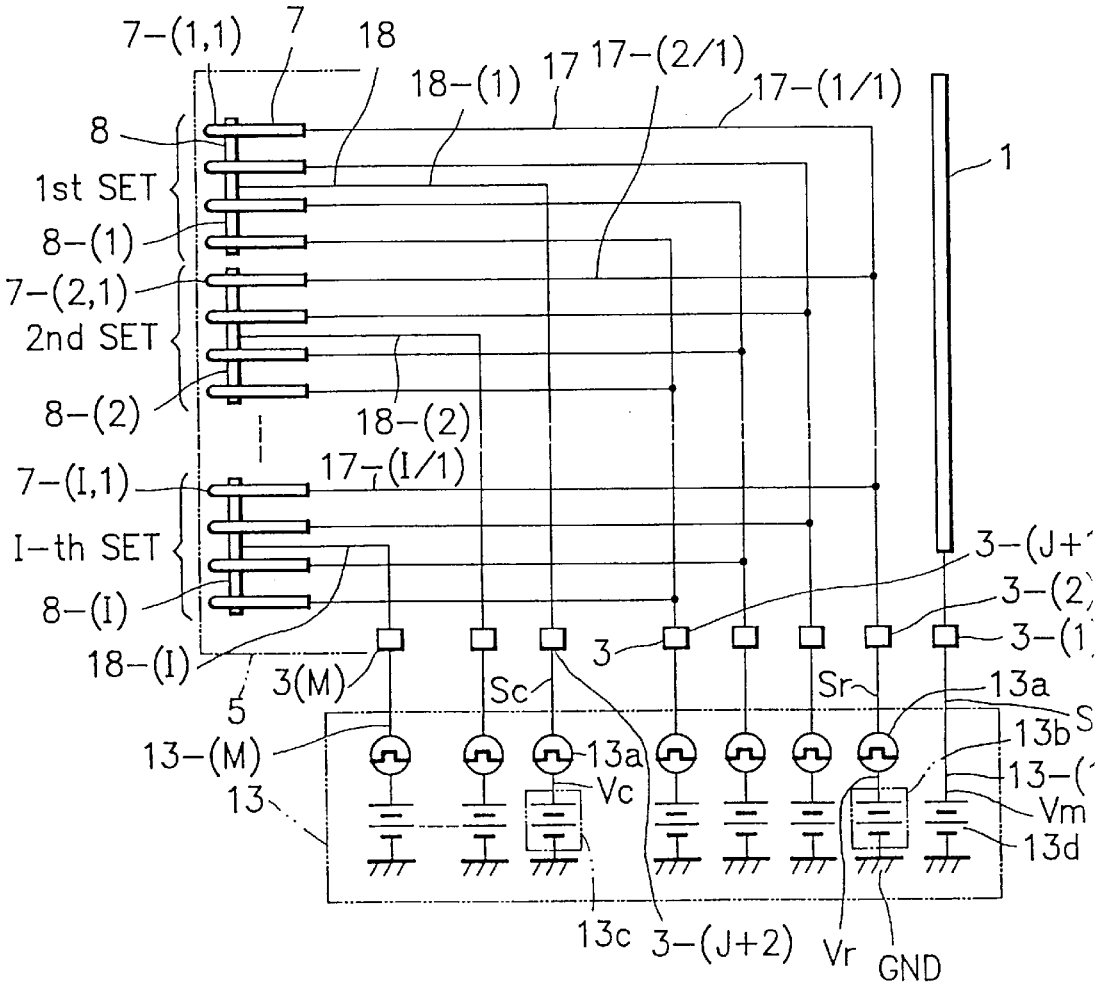
FIG. 4 illustrates a driver circuit of the recording device of FIG. 2.

FIG. 4 is a circuit diagram of essential parts of the recorder R1.

The ejection electrodes 7 amount to N in total, where N is a relatively large number. As shown in FIG. 4, the N electrodes 7 are settled into a total of I electrode sets each consisting of a total of J elements as electrodes 7, where J is a predetermined integer (=4 in the present embodiment) and I=N/J (=N/4), and are each identified by a corresponding number 7-(i, j), where i is a set identification number such that $1 \leqq i \leqq I$, and j is an element identification number such that $1 \leqq i \leqq J$ (=4).

In an arbitrary i-th set, the J electrodes 7-(i,1), 7-(i, 2), . . . , 7-(i,J) are commonly connected by a corresponding one 8-(i) of the control electrodes 8, which electrodes 8 thus amount to I in total.

A respective one of the N ejection electrodes 7 has a conductor 17 connected thereto. Then, a total of N conductors 17 are grouped into a total of J conductor groups each consisting of a total of I conductors 17, and are each identified by a corresponding number 17-(q/p), where p is a group identification number such that $1 \leqq p \leqq J$ (=4), and q is an intra-group identification number such that $1 \leqq q \leqq I$. More specifically, p=j and q=i, so that a conductor 17-(q/p) is connected to ejection electrode 7-(i, j).

Moreover, a respective one of the I control electrodes 8 has a conductor 18 connected thereto and identified by an id 18-(r) corresponding thereto such that r=i.

The pads 3 amount to M in total, where M=I+J+1, and are numbered from the right in FIG. 4 so that they are each identified by a corresponding number 3-(m), where m is an integer such that $1 \leqq m \leqq M$.

Then, an arbitrary pad 3-(m) is connected: solely to the conducting electrode 1 if m=1; commonly to a total of I corresponding ones {17-(q/p); q(=i)=1~I, p(=j)=m−1} of the N conductors 17 if $1 \leqq m-1 \leqq J$, i.e. if $2 \leqq m \leqq J+1$; and individually to a corresponding one 18-(r; r(=i)=m−J−1) of a total of I conductors 18 if $1 \leqq m-J-1 \leqq I$, i.e. if $J+2 \leqq m \leqq M$.

The voltage driver 13 includes a total of M voltage imposing circuits 13-(m) each connected to a corresponding one 3-(m) of the M pads 3, for imposing a relatively high bias voltage signal Sm on the conducting electrode 1 in a continued manner and level-controlled voltage signals Sr and Sc on the enjection and control electrodes 7 and 8 in a selective manner, respectively.

For $2 \leqq m \leqq M$, each voltage imposing circuit 13-(m) is composed of a switching transistor 13*a* controlled from the controller, and a dc voltage source 13*b* (if $2 \leqq m \leqq J+1$) or 13*c* (if $J+2 \leqq m \leqq M$) connected between the transistor 13*a* and a grounded node GND. If m=1, the voltage imposing circuit 13-(1) merely comprises a dc voltage source 13*d*.

The voltage sources 13*b*, 13*c* and 13*d* supply a high-level dc working voltage Vr, a higher dc control voltage Vc and a yet higher dc bias voltage Vm, respectively, such that Vr<Vc<Vm. The switching transistor 13*a* thus supplies the voltage Vr at each circuit 13-(m) for $2 \leqq m \leqq J+1$ or the voltage Vc at each circuit 13-(m) for $J+2 \leqq m \leqq M$, when it is switched on, and a low dc voltage Vor (Vor<Vr) at each circuit 13-(m) for $2 \leqq m \leqq J+1$ or a lower dc voltage Voc (Voc<Vor) at each circuit 13-(m) for $J+2 \leqq m \leqq M$, when it is switched off.

Accordingly, it so follows that Sm=Vr (with a corresponding transistor 13*a* on) or Vor (with the transistor 13*a* off), Sc=Vc (with a corresponding transistor 13*a* on) or Voc (with the transistor 13*a* off), and Sm=Vm.

Figure 5A:
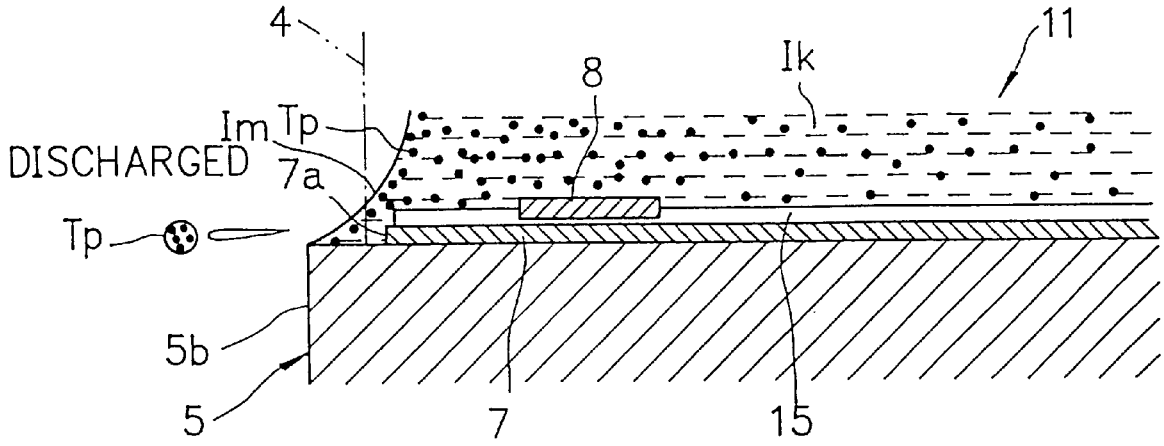
FIG. 5A is a detailed longitudinal section in a toner discharging state of an ink path of the recording device of FIG. 2.
Figure 5B:
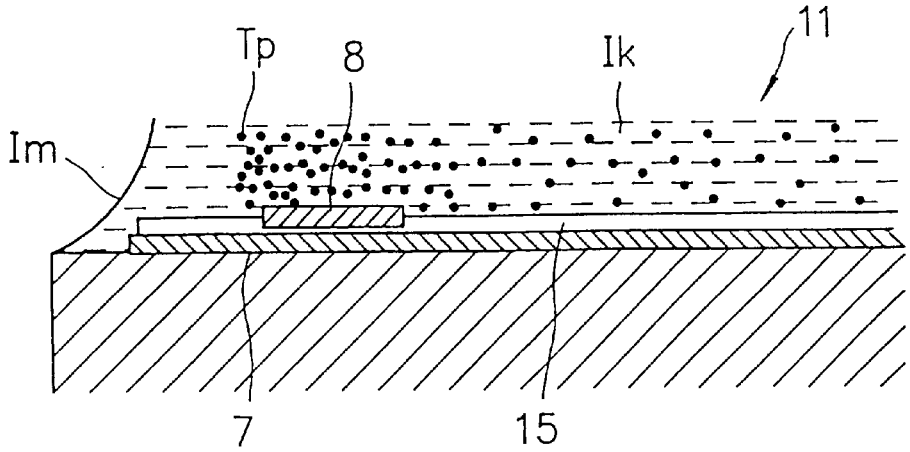
FIG. 5B is a detailed longitudinal section in a non-discharge state of an ink path of the recording device of FIG. 2.

FIGS. 5A and 5B show a toner discharging state and a non-discharge state of an ink path 11 of the recorder R1, respectively.

As shown in FIG. 5A, the ejection electrode 7 at each ink path 11 is longitudinally formed on the front peripheral part 5*b* of the substrate 5; with its front end 7*a* at a rearwardly offset position relative to the ink outlet 4. Over the ejection electrode 7 is formed an insulating film 15, which has the control electrode 8 transversely formed thereon. The ejection electrode 7 is effective near the front end 7*a*, where it is uncovered by the insulating film 15 and hence is exposed inside the ink path 11.

For an intended recording, employed ink Ik contains a system of adequate toner particles Tp dispersed in a transparent solution and charged to have an apparent positive polarity due to a zeta (ζ) potential. In operation of the recorder R1, the ink chamber 6 (FIG. 3) is supplied with a volume of circulating ink Ik containing charged toner particles Tp, so that a column of ink Ik invades therefrom into each ink path 11, forming an ink meniscus Im at the ink outlet 4.

In FIG. 5A, as the bias voltage Vm (FIG. 4) is imposed on the conducting electrode 1 (FIG. 3), there is developed a potential field in which lines of electric force representative of potential gradient longitudinally extend, sloping down from the conducting electrode 1 to the opposing electrode 2*b* (FIG. 3) of the grounded potential (0V), with corresponding tendencies to have associated toner particles Tp migrate toward the ink meniscus Im at each ink path 11, giving rise to an increased concentration of particles Tp near the ink outlet 4.

Moreover, in FIG. 5A, as the working voltage Vr (Vr<Vm, FIG. 4) is imposed on the ejection electrode 7, the potential field between the migration and opposing electrodes 1 and 2*b* is modified such that lines of electric force have decreased slopes between the electrodes 1 and 7, but have increased slopes between the electrodes 7 and 2*b*, with an increased tendency to force toner particles Tp near the ink outlet 4 to be discharged out of the ink meniscus Im, overcoming tensile forces therealong, so that discharged particles Tp fly toward the electrode 2*b*.

Figure 7A:
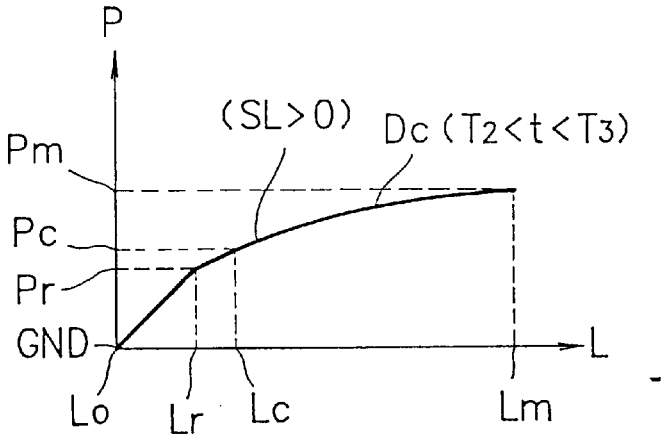
FIG. 7A is a graph showing a potential distribution in an axial direction of an ink path of the recording device of FIG. 2, as the ink path is put in the toner charging state.

To this point, in FIG. 5A, the control electrode 8 is applied with the control voltage Vc (Vr<Vc<Vm, FIG. 4), which has an intermediate level between the bias voltage Vm and the working voltage Vr so that the slopes of electric force lines are kept relaxed between the electrodes 1 and 7 and steep between the electrodes 7 and 2*b* (cf. FIG. 7A). As a result, toner particles Tp are discharged from the ink outlet 4.

However, in FIG. 5B, as the control signal Sc (FIG. 4) is switched over such that the low-level voltage Voc (0<Voc<Vr, FIG. 4) is imposed on the control electrode 8, the electric force lines describe valley-shaped traces near the electrode 8 (cf. FIG. 7B), having their slopes progressively increased between the electrode 1 and 8, with increased shifting tendencies, and inverted like cliffs between the electrodes 8 and 7, substantially keeping toner particles Tp from being shifted beyond a potential summit at the electrode 7, causing the concentration of particles Tp to be sufficiently thick around the control electrode 8 for an immediate subsequent discharge and to be too thin near the ink meniscus Im to effect a discharge. As a result, the discharge of toner particles Tp is restricted.

Figure 6A:
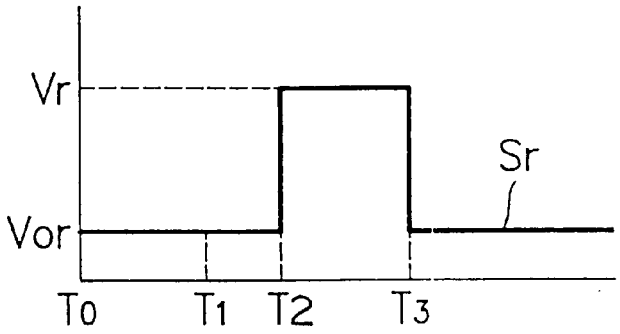
FIG. 6A is a time chart of a voltage signal imposed on a group of ejection electrodes of the recording device of FIG. 2, as an associated ink path experiences the toner charging state.
Figure 6B:
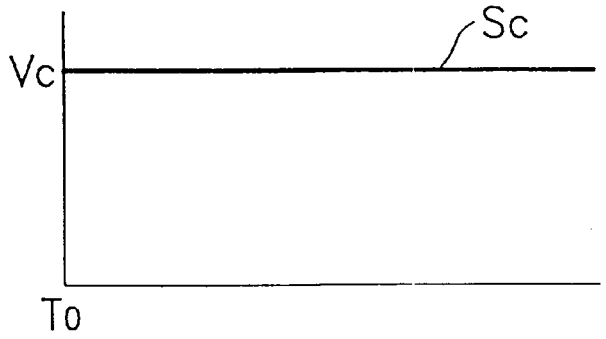
FIG. 6B is a time chart of a voltage signal imposed on a recording control electrode of the recording device of FIG. 2, as an associated ink path experiences the toner charging state.
Figure 6C:
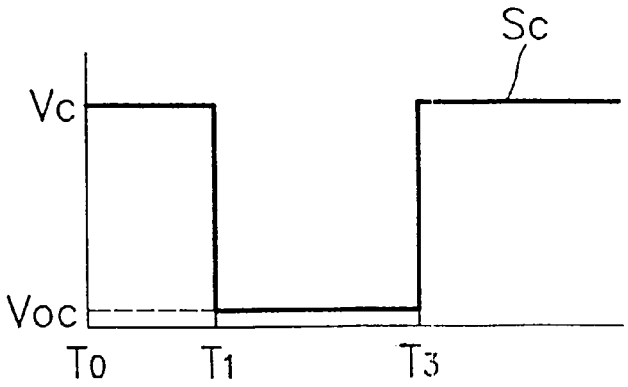
FIG. 6C is a time chart of the voltage signal of FIG. 6B, as each associated ink path experiences the non-discharge state.

FIGS. 6A and 6B show variations of the recording signal Sr and the control signal Sc, respectively, as an associated ink path 11 experiences the toner discharging state of FIG. 5A. FIG. 6C shows variations of the control signal Sc, as the ink path 11 experiences the non-discharge state of FIG. 5B.

As shown in FIGS. 6A and 6B, for the toner discharge, the transistor 13*a* of any associated voltage imposing circuit 13-(m) (FIG. 4) is controlled so that, if $2 \leqq m \leqq J+1$ (connected to a ejection electrode 7), it turns on at a time T2, when the recording signal Sr is switched over from the low voltage Vor to the high voltage Vr, and turns off at a time T3 (T3>T2), when the signal Sr is switched over from the voltage Vr to the voltage Vor, and if $J+2 \leqq m \leqq M$ (connected to a control electrode 8), it is kept on to hold the control signal Sc at the high voltage Vc, while the transistor 13*a* of the circuit 13-(1) remains on to supply the bias voltage Vm to the conducting electrode 1, as the recorder R1 is powered on at an initial time T0.

However, as shown in FIG. 6C, to effect a restriction of the toner discharge (i.e. for non-discharge), the transistor 13*a* of the circuit 13-(m; as $J+2 \leqq m \leqq M$) (connected to a control electrode 8) is controlled to turn off at a time T1 (T1<T2), when the control signal Sc is switched over from the high voltage Vc to the low voltage Voc, and turn on at the time T3, when the signal Sc is switched over from the voltage Vco to the voltage Vc.

Figure 7B:
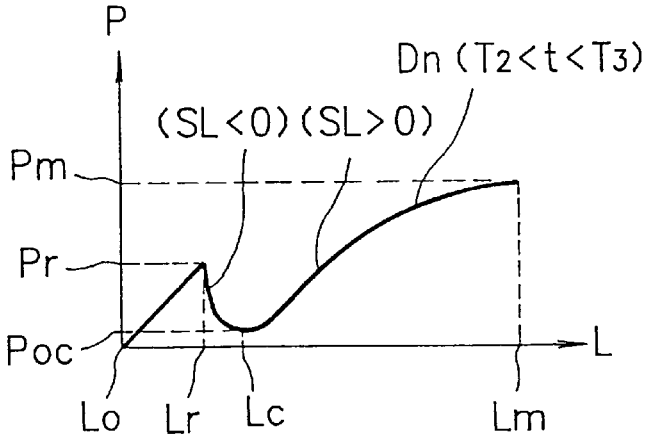
FIG. 7B is a graph showing a potential distribution in an axial direction of an ink path of the recording device of FIG. 2, as the ink path is put in the non-discharge state.

FIG. 7A shows a longitudinal potential distribution Dc of an ink path 11 put in the toner charging state during a time interval between the times T2 and T3, and FIG. 7B, a longitudinal potential distribution Dn of an ink path 11 put in the non-discharge state in the time interval between T2 and T3. FIG. 70 concurrently shows a longitudinal potential distribution Dpn of an ink path 11 in a non-discharge preparation period between the times T1 and T2, and a longitudinal potential distribution Dw of an ink path 11 put in a discharge waiting state after the time T3 or before the time T1 (for Dc or Dpn) or T2 (for Dc).

Figure 7C:
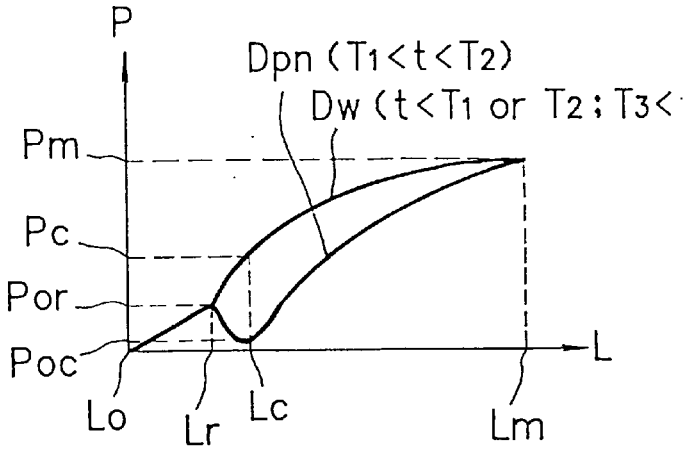
FIG. 7C is a graph showing a potential distribution in an axial direction of an ink path of the recording device of FIG. 2, as the ink path is put in a discharge waiting state or a preparation period for discharging toner particles.

In graphs of FIGS. 7A to 7C, defined by abscissa L is a distance in a longitudinal direction from an origin Lo located on an outside of the opposing electrode 2*b* (or of a sheet paper 12 put thereon, FIG. 2), and ordinate P is a relative potential along a longitudinal centerline of an associated ink path 11 with respect to an absolute potential of the grounded node GND. The ordinate is adequately varied in scale between the figures for a facilitated comprehension.

The distance L has a designed value Lr at the front end 7*a* (FIG. 5*a*) of the ejection electrode 7, Lc at a widthwise central point of the control electrode 8, and Lm at a front side of the conducting electrode 1 (FIG. 3), such that Lo<Lr<Lc<Lm.

The potential P is null on the origin Lo, and has at the distance Lr a value Pr (FIGS. 7A and 7B) or Por (FIG. 7C) corresponding to the high level Vr or low level Vor of the recording voltage signal Sr (FIG. 6A), respectively, at the distance Lc a value Pc (FIGS. 7A and 7C) or Poc (FIGS. 7B and 7C) corresponding to the high level Vc or low level Voc of the control voltage signal Sc (FIGS. 6B and 6C), respectively, and at the distance Lm a value Pm (FIGS. 7A to 7C) corresponding to the voltage Vm of the bias voltage signal Sm (FIG. 4), such that 0<Poc<Por<Pr<Pc<Pm.

Each potential distribution Dc, Dn, Dw or Dpn has a slope SL=dP/dL (or gradient $\partial P/\partial L$) at any distance L, which slope represents a magnitude and a direction (a sense inclusive) of an electromotive force (hereafter "emf") that the potential P applies to charged toner particles Tp (FIGS. 5A and 5B) at the distance L. The toner particles Tp thus have a tendency to move toward the opposing electrode 2*b* (to the left in the figures) if the slope SL is positive, or toward the conducting electrode 1 (to the right) if the slope SL is negative.

In FIG. 7A, the slope SL of the potential distribution Dc in the toner discharging state is kept positive between from the distance Lm to the distance Lr, causing toner particles Tp to be leftwardly shifted, and has an increased positive value between from Lr to Lo so that the particles Tp are discharged from the ink outlet 4 (FIG. 5A).

In FIG. 7B, the slope SL of the potential distribution Dn in the non-discharge state has a progressively increasing positive value between from Lm to Lc, providing toner particles Tp with a corresponding tendency to leftwardly move, but has a progressively increasing negative value between from Lc to Lr, providing toner particles Tp with a corresponding tendency to rightwardly move, thus gathering the particles Tp near the control electrode 8 (FIG. 5B), substantially permitting no particles Tp to go beyond the ejection electrode 7. Although the slope SL has an increased positive value between from Lr to Lo, no particles Tp can be discharged.

In FIG. 7C, the slope SL of the potential distribution Dw in the waiting state has a progressively increasing positive value between from Lm to Lr, providing toner particles Tp with a corresponding tendency to be leftwardly biased, but has a decreased positive value between from Lr to Lo, thus failing to provide toner particles Tp with a sufficient tendency to overcome tensile forces at the ink meniscus Im (FIG. 5A).

As shown in FIG. 7C, the potential distribution Dpn in the non-discharge preparation period describes a similar curve to the potential distribution Dn in the non-discharge state. But, at the distance Lr, the former distribution Dpn has the potential Por, which is lower than the potential Pr of the latter distribution Dn, so that some toner particles Tp may go beyond the potential Por. However, the slope SL has a decreased positive value between from Lr to Lo, failing to discharge toner particles Tp from the ink outlet 4.

For an intended operation, the recorder R1 is powered on at the initial time T0 (FIGS. 6A to 6C), when the bias signal Sm (FIG. 4) is supplied from the voltage imposing circuit 13-(1) of the voltage driver 13 via the pad 3-(1) to the conducting electrode 1. Accordingly, with the bias voltage Vm imposed, the electrode 1 has the potential Pm (FIG. 7C) developed over the left side thereof. On the other hand, the opposing electrode 2*b* (FIG. 2) or a paper sheet 12 put thereon always has the grounded potential.

Concurrently, at each voltage imposing circuit 13-(m; 2≦m≦J+1) (FIG. 4), the switching transistor 13*a* is reset to an off-state in which the recording voltage signal Sr has the low level Vor (FIG. 6A). which voltage Vor is imposed via a corresponding pad 3-(m; 2≦m≦J+1) and a total of I corresponding conductors 17-(q/p; p=m−1, q=1~I) to a total of I corresponding ejection electrodes 7-(i, j ; i=1~I, j=m−1). Accordingly, with the low-level voltage Vor imposed, all the ejection electrode 7-(i, j ; i=1~I, j=1~J J) has the potential Por (FIG. 7C) developed at a point corresponding to the distance Lr.

Moreover, at each voltage imposing circuit 13-(m; J+2≦m≦M) (FIG. 4), the switching transistor 13*a* is set to an on-state in which the control voltage signal Sc has the high level Vc (FIG. 6B), which voltage Vc is imposed via a corresponding pad 3-(m; J+2≦m≦M) and a corresponding conductor 18-(r; r=m−J−1) to a corresponding control electrode 8-(i; i=m−J−1). Accordingly, with the high-level voltage Vc imposed, all the control electrode 8-(i; i=1~I) has the potential Pc (FIG. 7C) developed at a point corresponding to the distance Lc.

Therefore, along each ink path 11, there is now generated the potential distribution Dw (FIG. 7C). No recording is thus effected.

To effect a recording of a dot corresponding to a particular ink path 11 having a ejection electrode 7-(i, j; i=i', j=j') as a j'-th electrode in an i'-th electrode set (FIG. 4), firstly the control signal Sc being supplied to each of other control electrodes 8-(i; i≠i') than a corresponding control electrode 8-(i; i=i') is switched over from the high level Vc to the low level Voc at the time T1 (FIG. 6C) by turning off the transistor 13*a* of each corresponding voltage imposing circuit 13-(m; m=J+2~M and m≠J+1+i') (FIG. 4), changing the potential Pc to the potential Poc (FIG. 7C), while the control signal Sc being supplied to the corresponding control electrode 8-(i; i=i') is left, as it is set to the high level Vc (FIG. 6B).

Accordingly, along each ink path 11 corresponding to an arbitrary electrode 7-(i, j; i≠i', j=1~J) in other electrode sets than the i'-th electrode set, there is now generated the potential distribution Dpn (FIG. 7C). Along each ink path 11 corresponding to an arbitrary electrode 7-(i, j; i=i', j=1~J) in the i'-th electrode set, there is still developed the potential distribution Dw (FIG. 7C). Therefore, no recording is effected.

Secondly, at the time T2 (FIG. 6A), the recording signal Sr being supplied to the ejection electrode 7-(i, j; i=i', j=j') via a corresponding conductor 17-(q/p; p=j', q=i') is switched over from the low level Vor to the high level Vr, changing the potential Por (FIG. 7C) at each associated ejection electrode 7-(i, j; i=1~I, j=j') to the potential Pr (FIGS. 7A and 7B). by turning on the transistor 13*a* of a corresponding voltage imposing circuit 13-(m; m=1+j') (FIG. 4) so that the ejection electrodes 7-(i, j; i=1~I, j=j') connected to this circuit 13-(m; m=1+j') have their recording signals Sr likewise switched over.

Accordingly, along the particular ink path 11, there is now generated the potential distribution Dc (FIG. 7A), permitting the dot to be recorded or printed. Along each of ink paths 11 corresponding to the remaining ejection electrodes 7-(i, j; i=i', j≠j') of the i'-th electrode set, there is yet developed the potential distribution Dw (FIG. 7C), effecting no printing.

Along each ink path 11 corresponding to an arbitrary one of respective j'-th electrodes 7-(i, j; i≠i', j=j') of the remaining electrode sets (i.e. than the i'-th electrode set), there is now generated the potential distribution Dn (FIG. 7B), permitting no recording to be effected. Along each of ink paths 11 corresponding to the remaining ejection electrodes 7-(i, j; i≠i', j≠j') in the remaining electrode sets, there is still developed the potential distribution Dpn (FIG. 7C), effecting no printing.

Then, at the time T3 (FIGS. 6A and 6C), the respective transistors 13*a* of the voltage imposing circuits 13-(m; m=1+j' and m=1+J+i') are reset to their initial status, so that the potential distribution Dw (FIG. 7C) is established along each ink path 11.

As will be seen from the foregoing description, an electrostatic ink jet recording device R1 according to the embodiment comprises: a recording medium feed system (F1, 2) for feeding a recording medium (12) in a predetermined position; an ink jet head (H1, 20) composed of a head member (14) defining an ink chamber (6) and an array of N ink paths (11) communicating with the ink chamber at rear ends thereof, where N is a predetermined integer, the N ink paths (11) each having an ink jet outlet (4) at a front end thereof, a substrate member (5) formed with a total of M pads (3), where M is a predetermined integer, and an array of N ejection electrodes (7) each extending along a corresponding one of the N ink paths, the ink jet head being applicable so that the respective ink jet outlets of the N ink paths oppose the recording medium, as it is in the predetermined position; an ink supply system (4, 6, 10, 11) for supplying ink (Ik) containing toner particles (Tp) charged in a polarity, the ink supply system including the ink chamber (6), and the N ink paths (11); and a potential field generation system (1, 2*b*, 3, 7, 8, 13) for generating a potential field having a total of N potential distributions (Dc, Dn, Dw, Dpn) substantially independently developed along a total of N imaginary axes (L) each extending along a correspondent one of the N ink paths, to cause a selective one of the N ink paths to discharge a quantity of toner particles (Tp) from the ink jet outlet, the potential field generation system comprising an opposing electrode (2*b*) applicable in opposition to the N ejection electrodes, with the recording medium in between, as it is in the predetermined position, the N ejection electrodes (7) being settled into a total of I electrode sets each consisting of a total of J ejection electrodes (7-(i, j)), where I and J are predetermined integers such that I×J=N, the N ejection electrodes (7) also being grouped into a total of J electrode groups each consisting of a total of I ejection electrodes each constituting a corresponding one (7-(i, j; i=p, j=q)) of the J ejection electrodes of a corresponding one of the I electrode sets, a total of I control electrodes (8) each cooperative with the J ejection electrodes of a correspondent one of the I electrode sets to control a total of J associated ones of the N potential distributions, the M pads (3) including a total of J pads (3-(m; 2≦m≦J+1)) each connected to a pertinent one of the J electrode groups, and a total of I pads (3-(m; J+2≦m≦M)) each connected to a pertinent one of the I control electrodes, a total of M voltage imposing circuits (13-(m)) each connected to a pertinent one of the M pads for supplying a voltage signal (Sm, Sr, Sc) to the pertinent pad, and control means (C0, 13*a*) for controlling the respective voltage signals of the M voltage imposing circuits.

In other words, the recording device R1 includes a plurality of ink paths 11 each having at one end thereof an ink discharging outlet 4 and communicating at their other ends with an ink chamber 6, a plurality of ejection electrodes 7 arranged along the ink paths 11, a grounded opposing electrode 2*b* arranged in opposition to the ink outlets 4, with a sheet transfer route for holding a paper sheet 12 in between, and a voltage driver 13 for selectively imposing voltages on the ejection electrodes 7.

The ejection electrodes 7 are settled into a total of I electrode sets each consisting of a total of J ejection electrodes 7-(i, j), while respective j-th electrodes of the I electrode sets are commonly short-circuited.

A plurality of recording control electrodes 8 are each commonly provided to the J ejection electrodes 7-(i, j) of a corresponding one of the I electrode sets and disposed at a rearwardly offset position from respective front ends of the J ejection electrodes in an ink discharge direction.

The voltage driver 13 has a discharge biasing function due to the selective application of voltages to the short-circuited ejection electrodes 7, and a discharge restricting function due to a selective setting of a lower potential than a potential of the ejection electrodes 7 to the control electrodes 8.

The ink chamber 6 is provided with a conducting electrode 1. In this respect, the voltage driver 13 has a migration biasing function due to a setting of a higher potential than the potential of the ejection electrodes 7 to the conducting electrode 1. The voltage driver 13 further has a time-lag driving function for setting a control electrode 8 to the lower potential than the potential of the ejection electrodes 7 before a voltage imposition to the ejection electrodes 7.

More specifically, according to the embodiment, a substrate 5 constituting a head proper is made of a glass for example, and has the ejection electrodes 7 formed thereon to be stripe-shaped by a patterning in a lithographical manner. On the substrate 5 is fixed a cover member 14 of a synthetic resin. thereby defining the ink chamber 6 as well as the ink paths 11 and ink outlets 4.

The ink paths 11 are further defined by a plurality of spacers 16 as partition members disposed in correspondence thereto. The conducting electrode 1 is arranged on a rear wall of the ink chamber 6, at an opposite side to the ink paths 11. The conducting electrode 1 is exposed inside the ink chamber 6.

The cover member 14 is provided with a pair of ink circulation slots 10 connected to an unshown ink cartridge or external ink reservoir. The substrate 5 further has formed thereon a plurality of pads 3 as contacts patterned with a wider area with respect to a width of each recordiong electrode 7.

In the embodiment described, the ejection electrodes 7 are assorted into the I electrode sets each consisting of a total of four ejection electrodes 7-(i, j: i=1~I, j=1~4), and respective i-th electrodes of the I electrode sets are short-circuited to be commonly connected to a corresponding pad 3.

The control electrodes 8 are formed in a stripe shape. They are pattern-formed in a layer different from a wiring layer including the ejection electrodes 7, with an insulating layer 15 in between. Each control electrode 8 is arranged so as to extend in a perpendicular direction to associated ejection electrodes 7, at a rearwardly offset position from respective front ends of the ejection electrodes 7.

The voltage driver 13 comprises a number of voltage imposing means as circuits 13-(m) corresponding to the number of pads 3. The circuits 13-(m) each includes a direct-current voltage source 13*b*, and are connected to an unshown control means for analysing print data to control actions of the voltage imposing means.

The voltage driver 13 is implemented for setting potentials to the electrodes 1, 7 and 8 in a following manner.

As shown in FIG. 7C, in a waiting period corresponding to the potential distribution Dw, the potentials are set to meet an inequality relationship such that Pm (conducting electrode 1)>Pc (control electrode 8 at a high voltage level Vc)>Por (ejection electrode 7 at a medium voltage level Vor)>GND (opposing electrode 2*b* at a 0V), while the potential Por is designed to be low enough to keep toner particles Tp from being discharged.

For a recording, as shown in FIG. 7A, the potentials are set to meet an inequality relationship such that Pm (conducting electrode 1)>Pc (control electrode 8 at the high voltage level Vc)>Pr (ejection electrode 7 at a high voltage level Vr)>GND (opposing electrode 2*b* at the 0V).

In a non-discharge state in which the ink discharge is restricted, as shown in FIG. 7B, the potentials are set to meet an inequality relationship such that Pm (conducting electrode 1)>Poc (control electrode 8 at a low voltage level Voc)>Pr (ejection electrode 7 at the high voltage level Vr)>GND (opposing electrode 2*b* at the 0V).

The potential Pm of the conducting electrode 1 is set relative to a grounded potential of the opposing electrode 2*b*, to generate an electric potential field without causing a toner discharge therebetween, in consideration of tensile forces on an ink meniscus Im formed at each ink outlet 4.

Employabe ink for the recording is of a type that contains toner particles charged in an apparently positive polarity due to a zeta potential.

As the ink chamber 6 and ink paths 11 are filled with ink 1k, the recording device R1 is now put to an operation, when the ink outlets 4 have ink menisci Im formed therein.

The conducting electrode 1 and control electrodes 8 are applied with their required voltages to provide a potential distribution Dw shown in FIG. 7C, whereby charged toner particles Tp in the ink chamber 6 are caused to migrate toward the ink menisci Im so that they are shifted close thereto in a vicinity of a front end 7*a* of each ejection electrode 7.

Then, a particular ejection electrode 7-(i',j') is determined to be operated into a toner discharging state.

Other electrode sets than an i'-th electrode set that includes the particular ejection electrode 7-(i',j') have their control electrodes 8-(i; i=1~I subject to i≠i') set to a low potential Poc for cooperating with ejection electrodes 7-(i, j; i≠i', j=1~J) to provide another potential ditribution Dpn shown in FIG. 7C.

Therefore, those toner particles Tp concentrated in a vicinity of the front end 7*a* of each ejection electrode 7-(i, j; i≠i', j=1~J) are brought back to a location of an associated control electrode 8-(i; i≠i'), as shown in FIG. 5B.

Then, a necessary voltage Vr is imposed on a group of short-circuited ejection electrodes 7-(i, j; i=1~I, j=j') including the particular ejection electrode 7-(i', j'), developing a potential distribution Dc of FIG. 7A along an ink path 11 associated with the particular electrode 7-(i', j') and a potential distribution Dn of FIG. 7B along an ink path 11 associated with any of the other electrodes 7-(i, j; i≠, i', j=j').

The potential distribution Dc along the ink path 11 with the particular electrode 7-(i', j') has, between this electrode 7-(i',j') and the opposing electrode, a potential slope steep enough to discharge those toner particles Tp concentrated at the ink meniscus Im, so that they are forced to fly out of the ink outlet 4 (FIG. 5A).

The potential distribution Dn along the ink path 11 with any of the other electrodes 7-(i, j; i≠i', j=j') has a steep potential slope between that electrode 7-(i, j; i≠i', j=j')7-(i', j') and the opposing electrode. However, it further has a potential barrier developed between the electrode 7(i, j; i≠i', j=j') and a cooperative control electrode 8-(i; i≠i'), which barrier has brought back toner particles Tp to the location of control electrode 8-(i; i≠i'), leaving few toner particles Tp in the vicinity of ink meniscus Im (FIG. 5B). Therefore, no discharge is permitted.

After the toner discharge at the ink path 11 with the particular electrode 7-(i',j'), this ink path 11 is driven into a waiting state by changing the potential distribution Dc (FIG. 7A) to the potential distribution Dw (FIG. 7C).

To permit the foregoing operation, voltage signals Sr (for ejection electrodes 7) and Sc (for control electrodes 8) are varied with time as shown in FIGS. 6A to 6C, in which unconcerned control electrodes 8-(i; i≠i') are set for a low potential Poc at a time T1, before a concerned group of ejection electrodes 7-(i, j; i=1~I, j=j') are set for a high potential Pr at a time T2, before the concerned electrode group and the unconcerned control electrodes 8-(i: i≠i') are set for a medium or low potential Por and a high potential Pc, respectively, at a time T3, while a concerned control electrode 8-(i; i=i') is kept set for the high potential Pc.

Such operations are repeated to have toner particles Tp deposited on a paper sheet 12 fed in position (to be held there or continuously transfered therethrough), before they are thermally fixed to complete a recording or printing.

It will be seen that the recording device R1 may be a line print type that should be allowed for a great reduction of pad number as well as for a great augmentation in density of ejection electrodes or ink paths.

According to the embodiment described, a voltage Vr is imposed through a single pad 3-(m; 2≦m≦J+1)onto a group of short-circuited ejection electrodes 7-(i, j; i=1~I, j=j'), and a low potential Poc for restricting a toner discharge is set at control electrodes 8-(i; i≠i') cooperative with sets of ejection electrodes 7-(i, j; i≠i', j=1~J), thereby causing an intended particular ink path 11 associated with a ejection electrode 7-(i', j') to discharge toner particles Tp, permitting a printing action to be guaranteed with an equivalent quality to a conventional example, with a greatly reduced number of pads 3 formed on a substrate 5, allowing an ink jet head to be greatly reduced in size, resulting in a reasonable contribution to a reduction in size of a recording device.

Moreover, even in a case using a great number of ejection electrodes, the number of necessary pads for connection to a voltage driver is effectively limited to a relatively small increase, thus permitting a high-density integration of ejection electrodes to afford a recording head with a very high resolution.

The reduction of pad number is evaluatable by a function E(I, J), such that E(I, J)=I×J−(I+J+1). For a total of N ejection electrodes, where N=I×J, the necessary pad number can be substantially minimized to a $2N^{1/2}$.

Further, according to the embodiment, an ink chamber 6 is provided with a conducting electrode 1 drivable to a high potential Pm, and a voltage driver 13 is adapted to develop a potential distribution Dc for a toner discharge, as well as a potential distribution Dw in a discharge waiting state, without extremal potentials between the conducting electrode 1 and a front end 7*a* of each concerned ejection electrode 7, so that charged toner particles Tp in the ink chamber 6 are caused to migrate to a vicinity of the front end 7*a* of electrode, permitting a prompt supplementation of toner particles Tp to be achieved at an ink meniscus Im even after a toner discharge, thus allowing a substantially continuous ink discharge.

Still more, according to the embodiment, to obtain a non-dischirge state, a voltage driver 13 provides at a time T1 (FIG. 6C) a control electrode 8-(i; i≠i') with a lower potential Voc than potentials Por of a set of cooperative ejection electrodes 7-(i, j; i≠i', j=1~J), before providing at a time T2 (FIG. 6A) a j'-th one 7-(i, j; i≠i', j=j') of the cooperative ejection electrodes 7-(i, j; i≠i', j=1~J) with a high potential Pr.

Accordingly, at the set of ejection electrodes 7-(i, j; i≠i', j=1~J), where no discharge is desired, those particles Tp shifted near front ends 7*a* of the ejection electrodes 7-(i, j; i≠i', j=1~J) are once brought back to a located position of the control electrode 8-(i; i≠i'), before the j'-th ejection electrode 7-(i, j; i:≠i', j=j') cooperates with the opposing electrode 2*b* to have a steep potential slope established therebetween. Therefore, an undesirable discharge is effectively restricted.

In the foregoing description, supplied toner particles Tp are charged in a positive polarity. Toner particles may however be charged in a negative polarity, providing that the potential distribution is inversed in polarity over the range between the conducting electrode 1 and the opposing electrode 2*b*.

The total number of ejection electrodes may be voluntarily set. It may amount to N' such that N (=IJ)<N'<(I+1)J or that N<N'<I(J+1), with a surplus ΔN (=N'−N) such that 0<ΔN<J or that 0<ΔN<I, respectively.

In such a case, the N' ejection electrodes may be settled into a combination of a total of $I_1$ first electrode sets each consisting of a toal of $J_1$ ejection electrodes and a total of $I_2$ second electrode sets each consisting of a toal of $J_2$ ejection electrodes such that $I_1$ $J_1$+$I_2$ $J_2$=N', providing that the substrate 5 has a total of M' pads such that M'=1 (for a bias voltage signal)+($I_1$+$I_2$) (for recording voltage signals)+($J_1$+$J_2$) [for control voltage signals].

Or alternatively, if 0<ΔN=J'<J, the ΔN ejection electrodes may be commonly controlled with an additional control electrode 8-(i; i=I+1), providing that J' of J electrode groups each contain a j-th one 7-(i, j; i=I+1) of theΔN ejection electrodes as an additional electrode, while J–J' of the J electrode groups are left, as they each consist of I ejection electrodes, and that the voltage driver 13 is adequately controlled in consideration of the foregoing description. In this case, the substrate 5 should have a total of M+1 pads.

Figure 8:
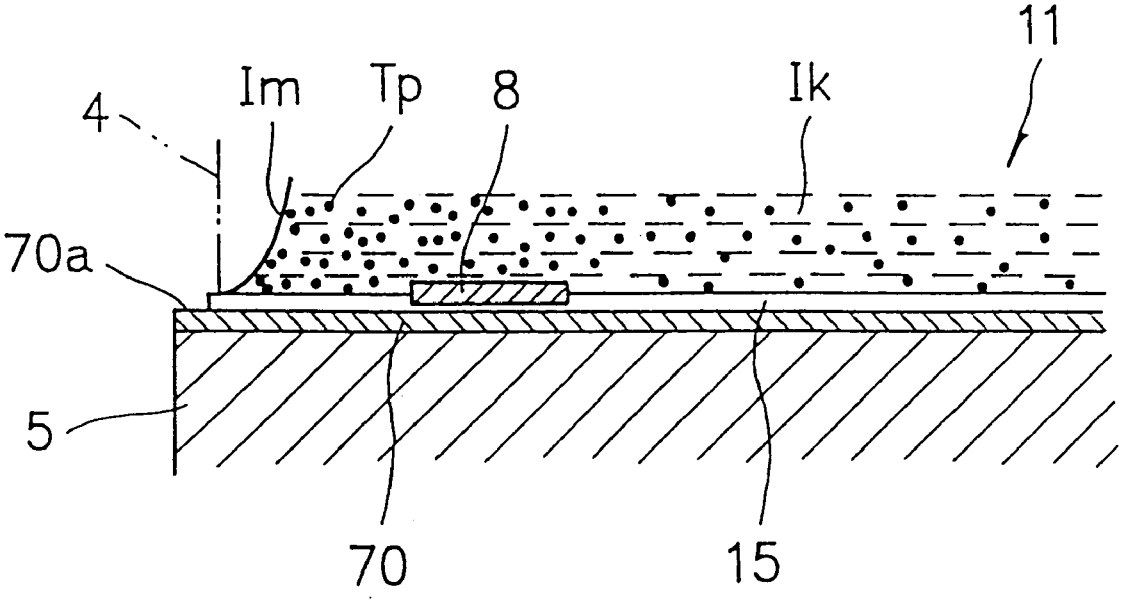
FIG. 8 is a section along an ink hole of an electrostatic ink jet recording device according to another embodiment of the invention.

FIG. 8 is a section along an ink hole of an electrostatic ink jet recording device according to another embodiment of the invention. Like members are designated by like reference characters.

In this embodiment, each recording electrode 70 has a front end 70*a* thereof at a position slightly exceeding an ink outlet 4 of an associated ink path 11, to render sharp a toner discharge action of the ink path 11

The electrode 70 may be formed on a substrate 5, or alternatively composed of a conductor of a separately fabricated flat conductor assembly to permit an exceeding position beyond a critical end of the substrate 5.

The electrostatic ink jet recording device R1 may thus comprise: a recording medium feed system (F1, 2) for feeding a recording medium (12) in a predetermined position; an ink jet head (H1, 20) composed of a head member (14) defining an ink chamber (6) and an array of N' ink paths (11) communicating with the ink chamber at rear ends thereof, where N' is a predetermined integer, the N' ink paths (11) each having an ink jet outlet (4) at a front end thereof, a substrate member (5) formed with a total of M pads (3), where M is a predetermined integer, and an array of N' ejection electrodes (7; 70) each extending along a corresponding one of the N' ink paths, the ink jet head being applicable so that the respective ink jet outlets of the N' ink paths oppose the recording medium, as it is in the predetermined position; an ink supply system (4, 6, 10, 11) for supplying ink (Ik) containing toner particles (Tp) charged in a polarity, the ink supply system including the ink chamber (6), and the N' ink paths (11); and a potential field generation system (1, 2*b*, 3, 7, 8, 13; 70) for generating a potential field having a total of N' potential distributions (Dc, Dn, Dw, Dpn) substantially independently developed along a total of N' imaginary axes (L) each extending along a correspondent one of the N' ink paths, to cause a selective one of the N' ink paths to discharge a quantity of toner particles (Tp) from the ink jet outlet, the potential field generation system comprising an opposing electrode (2*b*) applicable in opposition to the N' ejection electrodes, with the recording medium in between, as it is in the predetermined position, the N' ejection electrodes (7; 70) being settled into a total of I electrode sets each consisting of a total of J ejection electrodes (7-(i, j)), where I and J are predetermined integers such that $I \times J = N = N' - \Delta N$, and another electrode set consisting of a total of ΔN ejection electrodes (7-(i, j; i=1+1, j=1~ΔN)), the N' ejection electrodes (7; 70) being grouped into a total of J−ΔN electrode groups each consisting of a total of I ejection electrodes each constituting a corresponding one (7-(i, j; i=p, j=q)) of the J ejection electrodes of a corresponding one of the I electrode sets, and a total of ΔN electrode groups each consisting of a total of I+1 ejection electrodes of which I ejection electrodes each constitute a corresponding one (7-(i, j; i=p, j=q)) of the J ejection electrodes of a corresponding one of the I electrode sets and of which the remaining ejection electrode (7-(i, j; i=I+1)) constitutes a corresponding one of the ΔN ejection electrodes of said another electrode set, a total of I+1 control electrodes (8) of which I control electrodes (8-(i; i=1~I)) are each cooperative with the J ejection electrodes of a correspondent one of the I electrode sets to control a total of J associated ones of the N' potential distributions and of which the remaining control electrode (8-(i; i=I+1)) is cooperative with the ΔN ejection electrodes of said another electrode set to control a total of ΔN associated ones of the N' potential distributions, the M pads (3) including a total of J pads (3-(m; $2 \leqq m \neq J+1$)) of which J−ΔN pads are each connected to a pertinent one of the J−ΔN electrode groups and of which ΔN pads are each connected to a pertinent one of the ΔN electrode groups, and a total of I+1 pads (3-(m; $J+2 \leqq m \neq 1+I+J+1$)) of which I pads are each connected to a pertinent one of the I control electrodes and of which the remaining pad is connected to said remaining control electrode, a total of M voltage imposing circuits (13-(m)) each connected to a pertinent one of the M pads for supplying a voltage signal (Sm, Sr, Sc) to the pertinent pad, and control means (C0, 13*a*) for controlling the respective voltage signals of the M voltage imposing circuits.

As will be underdstood from the foregoing embodiments, according to the invention, a voltage is imposed through a single pad onto a group of short-circuited ejection electrodes, and a low potential for restricting a toner discharge is set at control electrodes cooperative with sets of ejection electrodes, thereby causing an intended particular ink path associated with a ejection electrode to discharge toner particles, permitting a printing action to be guaranteed with an equivalent quality to a conventional example, with a greatly reduced number of pads formed on a substrate, allowing an ink jet head to be greatly reduced in size, resulting in a reasonable contribution to a reduction in size of a recording device.

Moreover, even in a case using a great number of ejection electrodes, the number of necessary pads for connection to a voltage driver is effectively limited to a relatively small increase, thus permitting a high-density integration of ejection electrodes to afford a recording head with a very high resolution.

Further, according to the invention, an ink chamber is provided with a conducting electrode drivable to a high potential, and a voltage driver is adapted to develop a potential distribution for a toner discharge, as well as a potential distribution in a discharge waiting state, without extremal potentials between the conducting electrode and a front end of each concerned ejection electrode, so that charged toner particles in the ink chamber are caused to migrate to a vicinity of the front end of electrode, permitting a prompt supplementation of toner particles to be achieved at an ink meniscus even after a toner discharge, thus allowing a substantially continuous ink discharge.

Still more, according to the invention, to obtain a non-discharge state, a voltage driver provides a control electrode with a lower potential than potentials of a set of cooperative ejection electrodes, before providing one of the cooperative ejection electrodes with a high potential. Accordingly, at the set of ejection electrodes, those particles shifted near front ends of the ejection electrodes are once brought back to a located position of the control electrode, before the ejection electrode cooperates with the opposing electrode to have a steep potential slope established therebetween. Therefore, an undesirable discharge is effectively restricted in an inventive manner.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An electrostatic ink jet recording device comprising:

an ink chamber containing a fluid with toner particles therein;

plural emission apertures each having one end that is in fluid communication with said ink chamber, another end of each of said emission apertures having a discharge end from which toner particles are ejected;

a conducting electrode that is a wall of an interior of said ink chamber impelling the toner particles from said ink chamber into said plural emission apertures, but not out of each of said discharge end, by electrophoresis when a first voltage is applied to said conducting electrode;

an opposing electrode spaced from said emission apertures;

plural control electrodes, each of said control electrodes extending into a different group of more than one of said emission apertures and selectively ejecting the toner particles from a respective one of each of said discharge end, toward said opposing electrode when a second voltage is applied to a respective one of said control electrodes;

plural ejection electrodes, each in a different one of said emission apertures and electrically insulated from said control electrodes, and selectively ejecting the toner particles from said respective one of each of said discharge end when a third voltage is applied to a respective one of said ejection electrodes; and a voltage driver controlling application of said first, second, and third voltage to said conducting electrode, said plural control electrodes, and said plural ejection electrodes, and setting the first voltage greater than the second voltage and the second voltage greater than the third voltage, wherein the toner particles are ejected from one of each of said emission aperture discharge end when the first voltage is applied to said conducting electrode, the second voltage is applied to one of said control electrodes in said emission apertures, and the third voltage is applied to one of said ejection electrodes in said emission apertures.

2. The device of claim 1, wherein said control electrodes are arranged and constructed so that when a voltage other than the second voltage is applied to a respective one of said control electrodes, said one of said control electrodes causes toner particles to withdraw into the respective one of said emission apertures away from the respective one of said discharge ends.

3. The device of claim 1, wherein said voltage driver provides the first voltage continuously to said conducting electrode when the device is operating.

4. The device of claim 1, wherein said wall of said ink chamber formed by said conducting electrode is a rear wall that is opposite said emission apertures.

* * * * *